US005711337A

United States Patent [19]

McKenney

[11] Patent Number: 5,711,337

[45] Date of Patent: Jan. 27, 1998

[54] TENT FRAME AND PARTY TENT

[76] Inventor: Joseph E. McKenney, 335 Devonshire Ln., Columbia, S.C. 29212

[21] Appl. No.: 801,959

[22] Filed: Feb. 18, 1997

Related U.S. Application Data

[60] Provisional application No. 60/018,360, May 15, 1996.

[51] Int. Cl.[6] ..... E04H 15/34

[52] U.S. Cl. ..... 135/121; 135/122; 135/908; 135/160; 135/120.4; 52/6; 52/79.1

[58] Field of Search ..... 135/121, 122, 135/123, 908, 158, 120.4, 135, 159, 160; 52/6, 79.1, 79.2, 79.3, 79.6, 79.13

[56] References Cited

U.S. PATENT DOCUMENTS

| | | | |
|---|---|---|---|
| 838,689 | 12/1906 | Comstock | 135/159 X |
| 1,481,019 | 1/1924 | Luebbert | 135/908 X |
| 1,808,693 | 6/1931 | Terzoli | 135/908 X |
| 1,839,076 | 12/1931 | Adams | 135/908 X |
| 3,004,542 | 10/1961 | Moody | 135/121 X |
| 3,424,178 | 1/1969 | Yazaki | 135/160 X |
| 4,558,713 | 12/1985 | Hagler et al. | 135/159 |
| 4,831,792 | 5/1989 | Berger | 52/6 X |
| 5,261,197 | 11/1993 | Pickle, Sr. | 52/79.1 X |
| 5,269,106 | 12/1993 | Stafford et al. | 135/122 X |
| 5,274,980 | 1/1994 | Zeigler | 135/908 X |
| 5,355,641 | 10/1994 | Levy | 52/6 X |
| 5,640,811 | 6/1997 | Boyle | 135/908 X |

FOREIGN PATENT DOCUMENTS

| | | | |
|---|---|---|---|
| 1338345 | 8/1963 | France | 135/123 |

*Primary Examiner*—Wynn E. Wood
*Attorney, Agent, or Firm*—Michael A. Mann

[57] ABSTRACT

A party tent has a frame that includes an inner frame supported above an outer frame by a plurality of truss members. The inner frame is smaller than the outer frame in at least one dimensional aspect so that the span across the inner frame is less than the span across the outer frame. In the preferred embodiment, at least one cross member extends across the inner frame and supports a vertical member that extends away from the surface. During the assembly, the internal frame of the tent is put together so that the covering can be placed over this frame while it is at a height of less than six feet. The vertical members are then erected under the covering, thus lifting and stretching the covering for an aesthetically pleasing appearance. After the internal frame, vertical members, and covering are in place, a series of legs is positioned under the tent, thus supporting the tent in a normal fashion. In an alternative embodiment, cables extending across the inner frame support the vertical members on an X-pattern formed by the intersecting cables. The present invention allows for the assembly of large 40 foot by 80 foot tents, in which the maximum height the heavy covering must be stretched is six feet, thus reducing the danger and difficulty of assembling the tent.

20 Claims, 3 Drawing Sheets

TENT FRAME AND PARTY TENT

BACKGROUND OF THE INVENTION

1. Field of the Invention

This application claims priority to a provisional application, application Ser. No. 60/018,360 filed May 15, 1996. The present invention relates generally to a tent or canopy. In particular, the present invention relates to a large "party" tent or covering supported by an internal frame, and a method for assembling the same.

2. Discussion of Background

"Party" tents or other large tents are used for various events and occasions to provide a cover for people or displays and to protect them from the elements. These tents can typically cover areas ranging from 20 feet by 20 feet to 40 feet by 80 feet. When dealing with large tents, a large number of labor-hours are generally needed to set up the tent.

The internal frame of large party tents is usually high, typically greater than ten feet. The covering of the tent can be constructed from canvas or other material that will resist water and provide a certain amount of shade. These coverings, especially for large tents, are very heavy.

After setting the internal frame, the covering must be put in place. With the weight of the covering and the height of the frame, sometimes more than ten feet high, at least one person must be positioned on a ladder to install the covering over the highest portion of the frame. Maneuvering this large amount of weight while standing on a ladder is not a safe practice and can result in injury to the people installing the tent. Furthermore, having to pull the covering onto the frame while on a ladder takes time.

Some smaller tents, typically 20 feet by 20 feet, are constructed with a two-dimensional box shape. A pair of cables are stretched across the box from corner to corner, thus forming an X-pattern in the center of the tent frame. A center pole can be supported on the intersecting cables, thus stretching the tent covering upward. This method and design works well for smaller sized tents, but for large tents, where the span of cable would have to cross is large, the cables sag too much and interfere with the interior of the tent, thus detracting from the aesthetics of the tent's appearance.

Therefore, there is a need for a new party tent frame design that can be easily and quickly assembled and covered by a small number of people, preferably without risk of injury.

SUMMARY OF THE INVENTION

According to its major aspects and broadly stated, the present invention is a party tent for covering a surface. The tent has an internal frame for supporting a covering that is preferably water-resistant and that provides some degree of shade from the sun. The frame comprises an inner frame supported above an outer frame by a plurality of truss members.

In the preferred embodiment, the outer frame is rectangular or square, with the inner frame being smaller in at least one dimension. Consequently, either the length dimension or the width dimension, or both dimensions of the inner frame, are smaller than the corresponding dimensions on the outer frame. The inner frame is supported in its position approximately five to six feet above the outer frame by a plurality of truss members. The truss members are attached to the inner and outer frame and extend from the outer frame at an incline toward the inner frame, thus supporting the inner frame above the outer frame.

In a preferred embodiment, the inner frame has at least one cross member extending between the two sides of the inner frame. Positioned at the center of this cross member is a holder that supports a vertical member. In larger tents the number of cross members is increased, and thus the corresponding number of vertical members may also be increased. Additionally, the frame, including the outer frame, inner frame, truss members, cross members, and vertical members, are supported by a series of legs disposed about the perimeter of the outer frame. The legs position the frame vertically in spaced relation to the ground, so that various activities can be conducted within the boundaries of the tent.

In another preferred embodiment of the present invention, the vertical members are supported by a series of cables, forming an X-pattern within the inner frame. Because the inner frame is dimensioned smaller than the outer frame, the span which the cable must cross to support the vertical member is smaller, thus permitting the cable supporting structure to be fitted with tents having a width greater than 20 feet.

A covering is attached to the outer frame and extends over the inner frame and the vertical members carded by the inner frame. The vertical members supporting the covering provide an attractive appearance for the tent and tent covering. Furthermore, the vertical members lift the tent covering enough so that water will not collect on the covering but will run off its edges.

In another preferred embodiment of the present invention, the truss members connecting the inner frame to the outer frame are inclined similarly to those described above; however, in this embodiment the truss members are also angled. In other words, the truss members support the inner frame above the outer frame as described above, but the truss members are not oriented perpendicular to either the inner frame or outer frame.

The method of assembling tent frame and covering is an important feature of the present invention. The first step in assembling the tent is to construct the internal frame comprising the outer frame, the inner frame, and the truss members which support the inner frame. When this internal frame is constructed, the height of the inner frame from the ground is less than the average height of a man, or less than about six feet. After this internal frame is complete, the covering is pulled over the outer frame and the inner frame, so that the entire frame is covered. Once the covering is in place and attached to the outer frame, the assemblers erect the vertical members of the tent by inserting these members under the covering and securing them into the holders carried by the cross members, or by positioning them on the crossing cables. By inserting the vertical members onto the internal frame, the tent covering is tensioned onto the frame, providing a tight, aesthetic appearance. Then, after the vertical members are erected, the legs to the tent are positioned under the tent around the perimeter of the outer frame, beginning with one side of the outer frame and finishing with the other. By assembling the tent in this fashion, no one is required to climb a ladder or install a covering over a ten foot pole. Consequently, the covering only needs to be dragged over a frame having a maximum height of six feet, which is easily and quickly accomplished by a small installation crew.

Another important feature of the present invention is the vertical members. The vertical members stretch and contour the tent covering to the shape and design desired. Therefore, by adding the vertical members, a more pleasing tent design is achieved without increasing the difficulty of installation.

Still another important feature of the present invention is the structure of the outer frame and the inner frame. Both the inner frame and the outer frame are constructed from a plurality of subparts, thus allowing the frames to be easily assembled, disassembled and transported.

Another feature of one of the preferred embodiments of the present invention is the positioning of the truss members at an angle. By angling the truss members so that they are not perpendicular to either the inner frame or the outer frame, the length of the truss members is increased, even though the distance between the inner frame and outer frame is not when compared to the previous designs. Consequently, longer truss members may be used to connect the inner frame to the outer frame. Therefore, the same parts as used for the subparts of the inner frame and the outer frame may be used for the truss members for a larger tent and vice versa. In other words, the subparts and truss members for various sized tents become interchangeable, and thus reduce the number of sections or pans that are needed. As an example, the subparts of the inner and outer frame for a 30'×30' tent are the same length as the truss members used in a 40'×40' tent.

Yet another feature of the present invention is the shape of the internal frame of the tent. While in the preferred embodiment the frame is rectangular in shape, the outer frame and inner frame can be constructed in a variety of shapes. Irrespective of the shape selected, the covering can be installed prior to erecting vertical members, thus preventing the need and subsequent danger of having to use a ladder.

Still another important feature of the present invention is the use of the outer and smaller inner frame to create an area defined by the inner frame at an elevation above the surface on which the tent is being erected, and which is no higher than a standing man and small enough so that it can be spanned by cables or cross supports that will in turn support vertical members. This feature enables the tent covering to be placed over the frame without the need for ladders and allows the use of vertical members to give the tent an aesthetically pleasing appearance when fully constructed.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
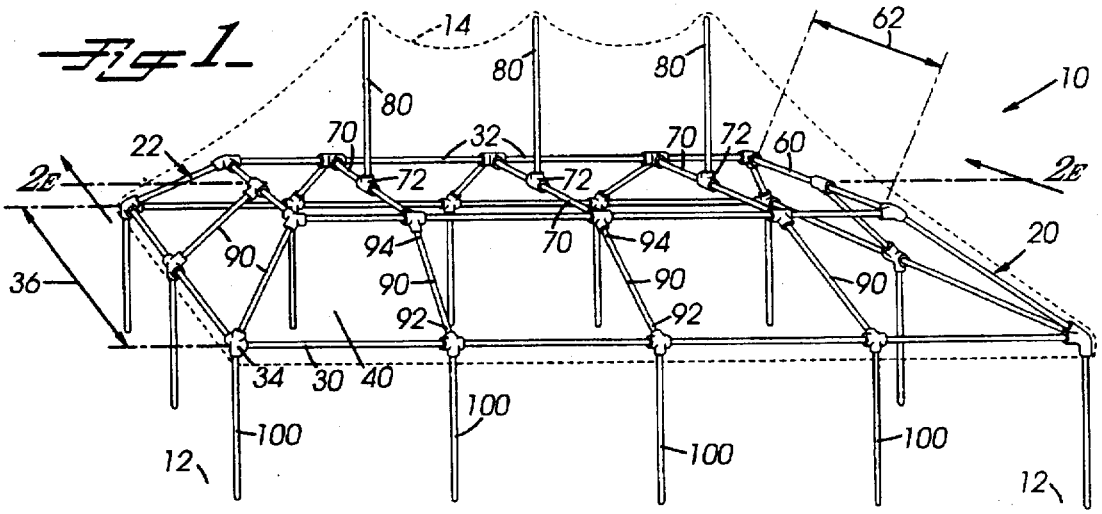
FIG. 1 is a perspective view of a tent frame showing three vertical members supported by cross members, according to a preferred embodiment of the present invention.

The present invention as shown in FIGS. 1 and 2 is a tent 10 including its frame, a tent frame 20 independent of the tent covering, and a method for assembling tent 10. In the following description, tent 10 is a large, "party" tent having typical dimensions ranging from 40 feet by 40 feet to 40 feet by 80 feet. However, during the description it is understood that tent 10 and tent frame 20 could be designed for either smaller or larger tents, but are preferably used for party tents greater than ten feet on a side. Tent 10, comprising tent frame 20 and a covering 14, is used to cover a surface 12. Tent 10 can be assembled on a variety of different surfaces 12, including both hard and soft surfaces.

Tent frame 20 comprises an internal frame 22 and a series of legs 100. Internal frame 22 comprises an outer frame 30 that supports an inner frame 60 by a plurality of truss members 90. In the preferred embodiment, outer frame 30 has a rectangular shape having a width 36 and a length 38. Truss members 90 having a first end 92 and a second end 94, extend from the perimeter of outer frame 30 from first end 92. Truss members 90 extend into the inner area 40 of outer frame 30, which is defined by the perimeter of outer frame 30. In addition to extending into inner area 40, truss members 90 extend at an incline with respect to surface 12. In other words, first end 92 of truss members are positioned closer to surface 12 than second end 94 of truss members 90.

Inner frame 60, also having a width 62 and a length 64, is supported above outer frame 30 with respect to surface 12 by truss members 90. Truss members 90 intersect inner frame 60 at their second end 94. In the preferred embodiment, width 62 and length 64 of inner frame 60 are smaller than width 36 and length 38 of outer frame. Consequently, the angular incline of truss members 90, assuming a constant length for truss members 90, will be dependent on width 62 and length 64 of inner frame 60. After internal frame 22 is constructed, the distance between the plane defined by outer frame 30 and the plane defined by inner frame 60 should be less than or equal to the height of an average man, or nominally six feet.

Those skilled in the an will recognize that both width 62 and length 64 of inner frame do not have to be smaller than the respective dimensions of outer frame 30. The only requirement for internal frame 22 is that at least one dimension, i.e., either width 62 or length 64 or both, should be smaller than the corresponding dimension of outer frame 30. Furthermore, it is not necessary for the angular incline of truss members 90 to be defined by the dimensions, width 62 and length 64, of inner frame 60. It is possible and contemplated by this disclosure that any one of the following variables could be changed and the remaining two adjusted to compensate for that variation: the angular incline of truss members 90, the dimensions of outer frame 30, or the dimensions of inner frame 60. It is only important that the plane of outer frame 30 with respect to the plane of inner frame 60 be less than about six feet apart. Those skilled in the art will recognize that this can be accomplished by changing the dimensions of truss members 90, inner frame 60, or outer frame 30, without departing from the scope of the present invention as described in this disclosure and defined by the appended claims.

Outer frame 30, inner frame 60, and truss members 90 are constructed from a plurality of subparts 32, which are connected to each other by fittings 34. In the preferred embodiment of the present invention, subparts 32 are constructed of aluminum tubing and fittings 34 are aluminum castings that are dimensioned to receive the aluminum tubing of subparts 32.

Those skilled in the art will recognize that other materials may be used for subparts 32 and fittings 34 and still remain within the scope of the present invention. Furthermore, it is also appreciated that other methods of attaching subparts 32 together instead of fittings 34 are possible and contemplated by this disclosure.

In the preferred embodiment of the present invention, at least one cross member 70 extends across width 62 of inner frame. For larger tents 10, as shown in FIG. 1, more cross members 70 extend across width 62 of inner frame 60. Positioned in approximately the center of cross member 70 is a holder 72, which is dimensioned and designed to support a vertical member 80. Vertical members 80 extend away from surface 12 and after installation of covering 14, support and stretch covering 14 above inner frame 60. Vertical members 80, like subparts 32, are preferably constructed of aluminum tubing. Furthermore, holder 72 can be any type of casting or fitting 34 known to those skilled in the art, for supporting two members at a perpendicular angle.

Those skilled in the art will recognize that any number of cross members 70 and vertical members 80 can be used to lift covering 14 without departing from the scope of the present invention. Preferably, corresponding to length 38 of outer frame 30, one cross member and subsequently one vertical member will be used when length 38 equals forty feet. As shown in FIGS. 1 and 2, three cross members 70 and three vertical members 80 are used on a larger tent having outer frame 30 dimensions of a forty foot width 36 and an eighty foot length 38. It is contemplated that the number of cross members 70 does not have to correspond to the number of vertical members 80, consequently, any number of cross members 70 and vertical members 80 may be used without departing from the scope of this invention as defined in the appended claims.

As stated above, a series of legs 100 is positioned about the perimeter of outer frame 30 and lifts internal frame 22 from surface 12. Legs 100 should be long enough so that when legs 100 are installed, people can easily walk under tent 10. Additionally, legs 100 are preferably constructed from aluminum tubing and connected to outer frame 30 by castings, similar to fittings 34. It should be noted that, as with other parts of the present invention, the material and connections of legs 100 can be modified or substituted without departing from the spirit and scope of the present invention.

After construction, covering 14, which is fastened to the perimeter of outer frame 30, extends over inner frame 60 and vertical members 80. Covering 14 can be constructed from any material known to those skilled in the art of tent making, such as, for example, canvas, nylon, vinyl, and cotton. Once covering 14 is in place, it provides an aesthetic appearance and protection to the area within tent 10.

Figure 2A:
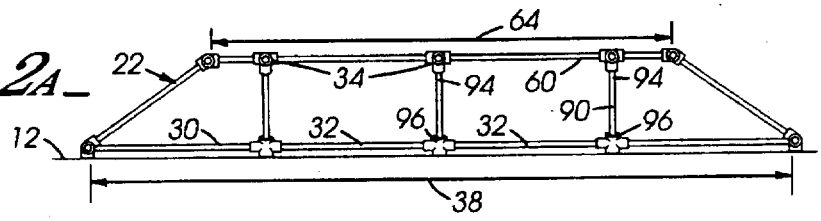
FIGS. 2A–E are a series of cross-sectional views, taken along line 2—2 of FIG. 1 of the tent and tent frame during the assembly process, according to a preferred embodiment of the present invention.
Figure 2B:
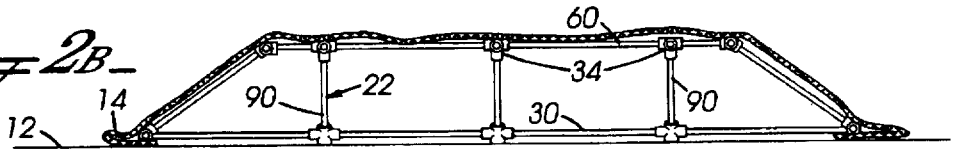

The assembly of tent 10 is a very important aspect of the present invention and is best seen in FIGS. 2A–E. The first step in assembling tent 10 is to construct internal frame 22. This step encompasses the construction of outer frame 30 and inner frame 60 from subparts 32 and fittings 34 and then connecting the inner frame 60 to outer frame 30 by truss members 90. Once internal frame 22 is constructed, the average height of internal frame 22 is ideally less than six feet, as best seen in FIG. 2A. At this height the next step of attaching the covering 14 to outer frame 30, so that covering 14 extends over inner frame 60, is made much easier than if one were trying to attach covering 14 to a higher frame, where a ladder would be required. Covering 14, after being attached to outer frame 30, has excess material and is not tight, as seen in FIG. 2*b*.

Figure 2C:
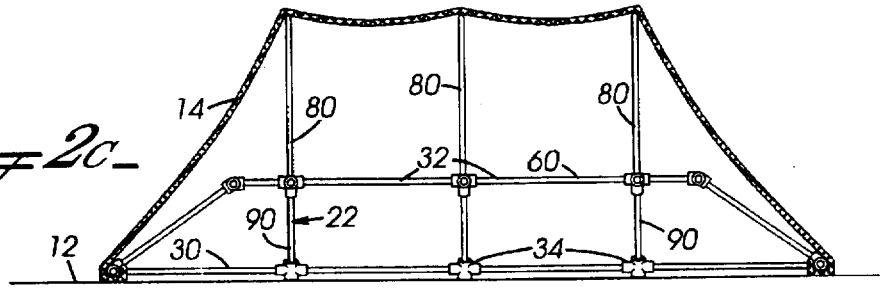
Figure 2D:
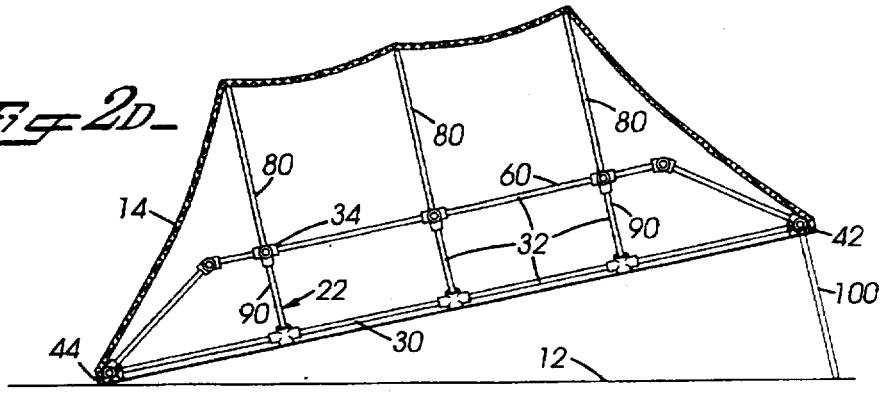
Figure 2E:
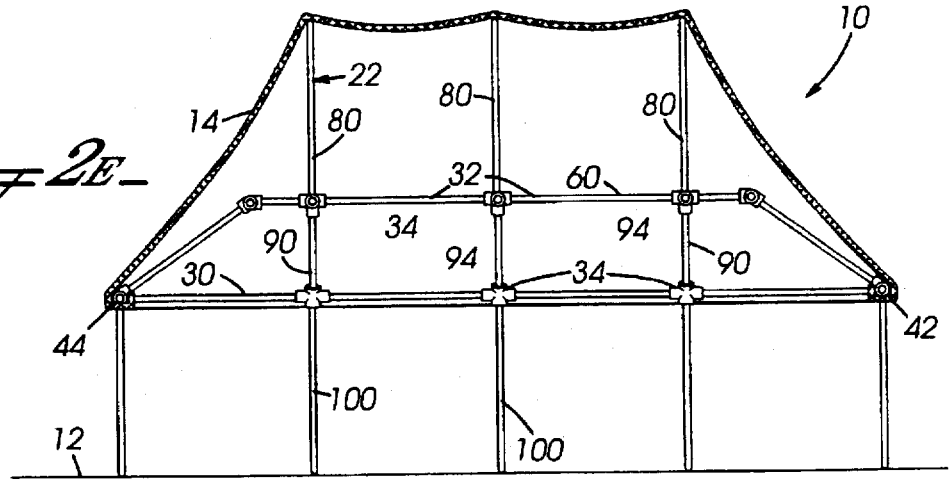

After attaching covering 14 to outer frame 30, vertical members 80 are erected from holders 72 and supported by cross members 70. By erecting vertical members 80, covering 14 is tensioned and stretched into place, thus providing an attractive appearance as shown in FIG. 2C. Once these steps have been completed without the need for a ladder, legs 100 are positioned under outer frame 30. Outer frame 30 has a first end 42 and a second end 44. The first series of legs 100 are positioned under first end 42 of outer frame 30, thus raising one side of internal frame 22, as seen in FIG. 2D. The next series of legs 100 are then placed under second end 44 of outer frame 30, thus lifting internal frame 22 and tent 10 to its normal height, as seen in FIG. 2E. At this time, if more legs 100 are needed to securely support tent 10, they can be deployed around the perimeter of outer frame 30.

Figure 3:
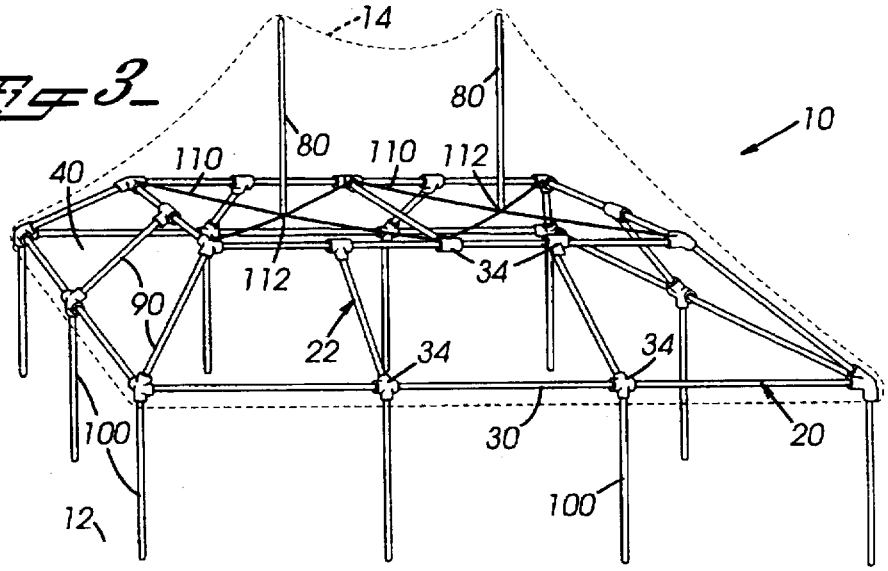
FIG. 3 is a perspective view of a tent showing two vertical members supported by a cable structure, according to another preferred embodiment of the present invention.

At times it is also necessary to secure tent 10 to surface 12. This is not necessary as a means of holding up tent 10, as in some designs, but is necessary to keep tent 10 from being blown away by the wind. Tent 10 can be secured to a 55 gallon drum filled with fluid or to surface 12. A drum filled with fluid is ideal for situations where surface 12 is hard, thus avoiding the need for objects to be inserted into surface 12. In FIG. 3, a tent 10 is shown staked to a soft surface 12, such as the ground.

Also depicted in FIG. 3 is an alternative embodiment for supporting vertical members 80. It is not necessary for vertical members 80 to be supported by cross members 70. A pair of cables 110 can be strung across width 62 of inner frame 60, a distance short enough so that cables 110 do not sag too much. One cable is typically extended from one corner across to the opposite corner of inner frame 60. The other cable is extended from one of the remaining corners and connects to the opposite side of inner frame 60, such that cables 110 form an X-pattern 112. Vertical member 80 is placed on the intersecting cables of this X-pattern 112, thus supporting vertical member 80 in a similar fashion to the way cross member 70 supports vertical member 80 in the preferred embodiment. Those skilled in the art will recognize that various alternative cabling structures or configurations could be used to support vertical member 80, and thus these configurations are within the scope of this disclosure.

Figure 4:
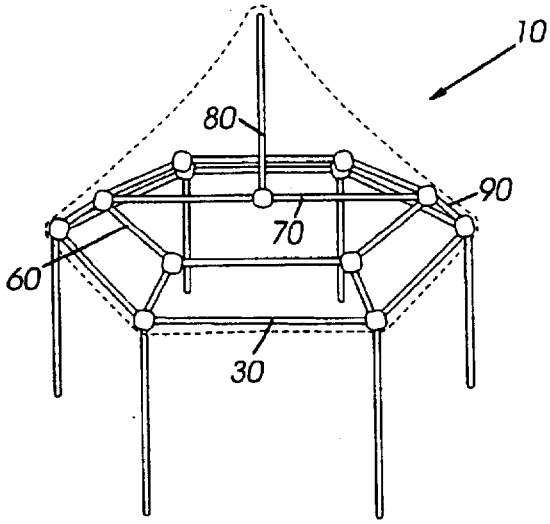
FIG. 4 is a perspective view of a tent having six sides, according to another preferred embodiment of the present invention.

As shown in FIG. 4, the teachings of the present invention can be used to construct tent 10 so that the dimensions of tent 10 are not rectangular. Specifically, in FIG. 4, tent 10 is shown having six sides and a single vertical member 80 extending from a single cross member 70. Consequently, other configurations of tent 10 are possible, including an additional number of sides, an additional vertical member 80, or any other combination. Furthermore, vertical members 80 may also be supported by cables 110 in any one of the configurations of tent 10.

The present invention solves the problem of having to use a ladder to place covering 14 over a high vertical member. The vertical members 80 of the present invention are not positioned until after coveting 14 has been attached to outer frame 30; consequently, it is only necessary for covering 14 to be extended over a frame that is ideally no more than six feet high. The present invention also solves the problem of extending cables 110 over a large area, where the sag in cable 110 makes it impractical to support vertical members 80 by cables 110. Inner frame 60, supported above outer frame 30 by truss members 90, lessens the area which cables 110 must span, thus reducing the amount of sag cables 110 experience and enabling cables 110 to be used to support vertical members 80. Furthermore, tent 10 is constructed and designed such that no center poles extending within tent 10 are used which would otherwise obstruct the interior of tent 10.

Figure 5:
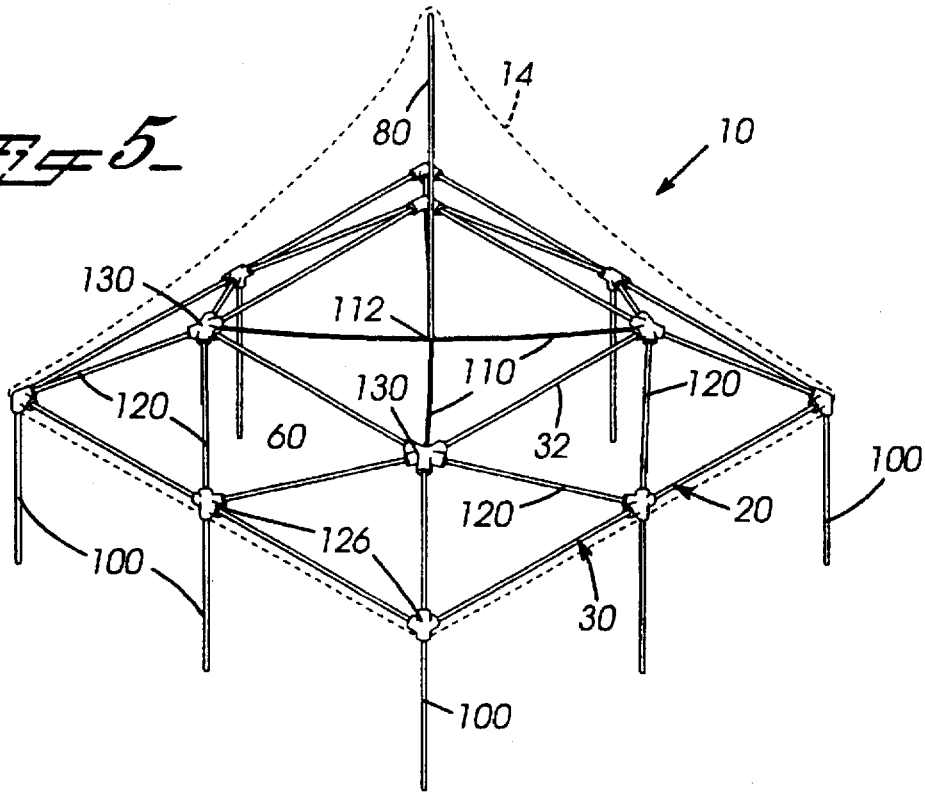
FIG. 5 is a perspective view of a tent frame having a single vertical member according to another preferred embodiment of the present invention.
Figure 6:
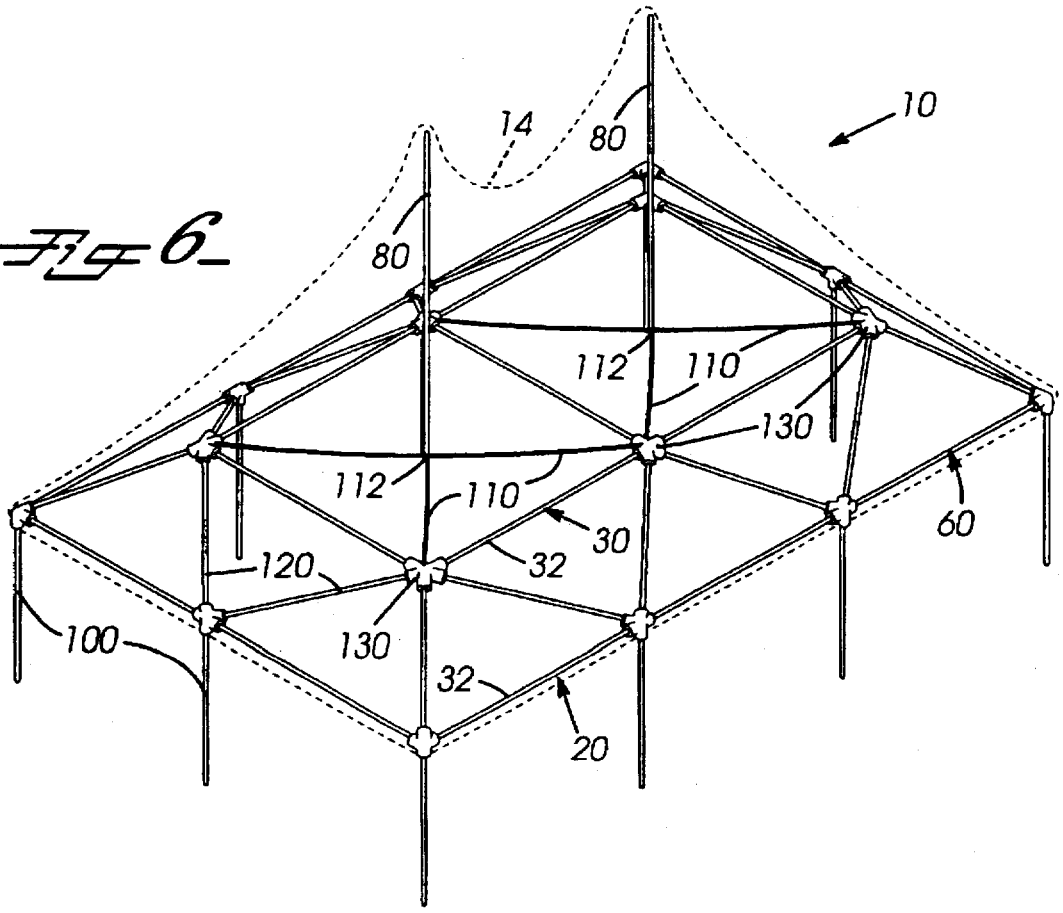
FIG. 6 is a perspective view of a tent frame have two vertical members according to another preferred embodiment of the present invention.

Another preferred embodiment of the present invention is shown in FIGS. 5 and 6. In this embodiment, inner frame 60 is supported above outer frame 30, as in the designs described above. However, inner frame 60 is supported from outer frame 30 with a plurality of angled trusses 120. Angled trusses 120 extend from a leg fitting 126, where leg 100 is connected to outer frame, to a five connection fitting 130, where angled trusses 120 connect to inner frame 60. While angled trusses 120 have an angular incline when extending from outer frame 30 to inner frame 60, angled trusses 120 are also in a position wherein angled trusses 120 are not perpendicular to either the plane defined by outer frame 30 or inner frame 60. In other words, angled truss members 120 are not perpendicular to any of the subparts 32 of inner frame 60 or outer frame 30. Basically, angled truss members 120 extend from the corners of outer frame 30 to the corners of inner frame 60. Angled truss members 120 then extend from the corners of inner frame 60 to a point along the side of outer frame 30 and are connected there by leg fittings 126, as seen in FIGS. 5 and 6.

A significant advantage of this type of design is that the length of angled truss members 120 is greater than truss members 90, without appreciably increasing the height of inner frame 60 relative to outer frame 30. By increasing the length of angled truss members 120 relative to truss members 90, it allows various pans to be interchangeable with other parts of the tent. For instance, subparts 32 of inner frame 60 and outer frame 30 for a 30'×30' tent may be used as angled truss members 120 for a 40'×40' tent. Consequently, the number of parts that must be produced for varying sizes of tents is reduced, thus reducing manufacturing costs. In addition, parts may be substituted between different sized tents when pans break or are lost, thus increasing the efficiency of the tent installations.

Finally, with this alternative preferred embodiment, inner frame 60 is small enough that cables 110 may be formed in an X-pattern 112 to support vertical member 80. In addition, it will be recognized that as shown in FIG. 6, several inner frames 60 may be fastened together to form a larger tent, while still retaining the ability to span cables 110 across the diagonals of inner frame 60 to support vertical members 80.

It will be apparent to those skilled in the art that many changes and substitutions can be made to the preferred embodiment herein described without departing from the spirit and scope of the present invention as defined by the appended claims.

What is claimed is:

1. A tent frame for supporting a covering over a surface, said tent frame comprising:

an outer frame having a first dimension and a second dimension;

a plurality of truss members carried by said outer frame;

an inner frame carried by said truss members, said inner frame having a first dimension and a second dimension, said first dimension of said inner frame being smaller than said first dimension of said outer frame, and said second dimension of said inner frame being smaller than said second dimension of said outer frame;

at least one vertical member carried by said inner frame and extending away from the surface, said at least one vertical member is supported by at least one cable extending across said inner frame; and means connected to said outer frame for positioning said outer frame in spaced relationship relative to the surface.

2. The tent frame as recited in claim 1, wherein each of said plurality of truss members has a first end and a second end, said first end attached to said outer frame and said second end attached to said inner frame so that said inner frame is positioned above said outer frame with respect to the surface.

3. The tent frame as recited in claim 1, wherein said at least one vertical member is centrally disposed with respect to said second dimension of said inner frame.

4. The tent frame as recited in claim 1, wherein said inner frame is positioned above said outer frame with respect to the surface.

5. The tent frame as recited in claim 1, further comprising a series of legs extending from said outer frame, so that said outer frame is in spaced relation to the surface.

6. The tent frame as recited in claim 1, wherein said outer frame has an inner area, said truss members extending from said outer frame toward said inner area with an angular incline with respect to the surface, said inner frame attached to said truss members so that said inner frame is positioned above said outer frame.

7. The tent frame as recited in claim 1, wherein said truss members extend from said inner frame to said outer frame at an angular incline with respect to the surface and at an angle that is not perpendicular to said inner frame or said outer frame.

8. The tent frame as recited in claim 1, wherein said outer frame and said inner frame are constructed from a plurality of detachable subparts so that when connected, said subparts of said outer frame and said inner frame form said outer frame and said inner frame, respectively.

9. A tent for covering a surface, said tent comprising:

an outer frame having a dimension;

a plurality of truss members carried by said outer frame;

an inner frame carried by said truss members, said inner frame having a dimension, said dimension of said inner frame being smaller than said dimension of said outer frame;

at least one vertical member positioned approximately in the center of said inner frame;

means carded by said inner frame for supporting said at least one vertical member; and a covering attached to said outer frame, said covering extending over said inner frame and said at least one vertical member.

10. The tent as recited in claim 9, further comprising a series of legs extending from said outer frame, said legs positioning said outer frame in spaced relation with respect to the surface.

11. The tent as recited in claim 9, wherein said outer frame has an inner area, said truss members extending from said outer frame toward said inner area with an angular incline with respect to the surface, said inner frame attached to said truss members so that said inner frame is positioned above said outer frame.

12. The tent as recited in claim 9, wherein each of said plurality of truss members has a first end and a second end, said first end attached to said outer frame and said second end attached to said inner frame so that said inner frame is positioned above said outer frame with respect to said surface.

13. The tent as recited in claim 9, wherein said outer frame and said inner frame have a generally polygonal shape.

14. The tent as recited in claim 9, wherein said outer frame and said inner frame are constructed from a plurality of detachable subparts so that when connected, said subparts of said outer frame and said inner frame form said outer frame and said inner frame, respectively.

15. A tent for use on a surface, said tent comprising:

an internal frame having an inner frame, an outer frame, and a plurality of truss members, said inner frame having a width and a length and said outer frame having a width and a length, said width of said inner frame being shorter than said width of said outer frame, said length of said inner frame being shorter than said length of said outer frame, each of said plurality of truss members having a first end and a second end, said first end of each of said plurality of truss members connected to said outer frame and extending at an incline relative to the surface and non-perpendicularly to said inner frame, said second end of said plurality of truss members connected to said outer frame, so that said inner frame is supported above said outer frame by said plurality of truss members;

a vertical member extending from said inner frame positioned approximately in the center of said inner frame;

a coveting extending over said internal frame and said vertical member; and a plurality of legs supporting said internal frame in spaced relation with respect to the surface.

16. The tent as recited in claim 15, wherein said second ends of said plurality of truss members are connected to said inner frame by five connection fittings.

17. The tent as recited in claim 15, wherein said plurality of legs and said plurality of truss members are connected to said outer frame by leg fittings.

18. The tent as recited in claim 15, wherein said inner frame is constructed from a plurality of subparts, each of said of subparts having a length; and wherein each of said plurality of miss members has a length, said length of each of said plurality of subparts of said inner frame being approximately equal to said length of each of said plurality of truss members.

19. The tent frame as recited in claim 1, further comprising a series of legs extending from said outer frame so that said outer frame is in spaced relation to the surface, and wherein said inner frame is positioned above said outer frame with respect to the surface.

20. The tent as recited in claim 9, wherein said outer frame and said inner frame are constructed from a plurality of detachable subparts so that when connected, said subparts of said outer frame and said inner frame form said outer frame and said inner frame, respectively, and said outer frame and said inner frame have a generally polygonal shape.

* * * * *